United States Patent [19]

Dimur

[11] Patent Number: 4,903,461

[45] Date of Patent: Feb. 27, 1990

[54] DEVICE FOR INSERTING SHEETS INTO ENVELOPES

[75] Inventor: Gérard Dimur, Epinay sur Orge, France

[73] Assignee: SMH Alcatel, Paris, France

[21] Appl. No.: 276,738

[22] Filed: Nov. 28, 1988

[30] Foreign Application Priority Data

Nov. 26, 1987 [FR] France ..... 87 16410

[51] Int. Cl.[4] ..... B65H 5/30

[52] U.S. Cl. ..... 53/569; 53/260; 53/266 A

[58] Field of Search ..... 53/266 A, 569, 260, 53/258, 255, 387, 252, 381 R; 271/268

[56] References Cited

U.S. PATENT DOCUMENTS

| | | | |
|---|---|---|---|
| 3,412,995 | 11/1968 | Parups | 271/268 |
| 3,568,401 | 3/1971 | Bonsch | 53/569 |
| 3,872,649 | 3/1975 | Wimmer | 53/569 |
| 4,077,181 | 3/1978 | Ashet et al. | 53/266 A X |
| 4,337,609 | 7/1982 | Foster et al. | 53/569 |
| 4,633,644 | 1/1987 | Haroutel et al. | 53/266 A X |

FOREIGN PATENT DOCUMENTS 0175999 4/1986 European Pat. Off. .

*Primary Examiner*—James F. Coan

*Attorney, Agent, or Firm*—Sughrue, Mion, Zinn, Macpeak & Seas

[57] ABSTRACT

A device for inserting sheets into envelopes has a fixed insertion station receiving empty envelopes and a fixed sheet inlet station, which stations are spaced apart from each other, together with a carriage for transferring sheets therebetween and driven between a retracted position beneath the sheet inlet station and an engaged position in an envelope present at the insertion station. The sheet insertion device is characterized in that it includes sheet grasping and pushing fingers (35) fixed to the carriage (33) and projecting slightly above the sheet inlet station (32), together with holding-down fingers (37) mounted above the inlet station and actuated to move between a retracted position and a holding-down position in which they hold a sheet down against the inlet station. The invention is applicable to automatically processing mail.

17 Claims, 6 Drawing Sheets

DEVICE FOR INSERTING SHEETS INTO ENVELOPES

REFERENCE TO RELATED APPLICATIONS

This application relates to U.S. application Ser. No. 07/276,606 filed-Nov. 28, 1988, entitled A DEVICE FOR CONTROLLING THE ADVANCE AND THE POSITIONING OF ENVELOPES IN AN INSERTION MACHINE to Jean-Pierre Meur, and U.S. application Ser. No. 07/276,607, filed-Nov. 28, 1988, entitled A DEVICE FOR EJECTING FILLED ENVELOPES, AND AN INSERTION MACHINE USING SAID DEVICE, to the applicant and both assigned to the same assignee.

The present invention relates to machines for automatically processing mail, and it relates more particularly to a device for use in such machines for inserting sheets into envelopes.

BACKGROUND OF THE INVENTION

In machines for automatically processing mail, an envelope unstacker at the outlet from a magazine of envelopes serves to take envelopes one by one from the magazine. A transfer device for transferring empty envelopes transfers the separated empty envelopes to an insertion station for inserting sheets into said envelopes.

At the insertion station, successive envelopes are stopped and held open. The sheets to be put into the envelopes (which sheets may be in the form of single sheets or in the form of bundles of sheets) are folded appropriate in a folding machine and are optionally made up into bundles by a bundling machine either before or after folding, and are then delivered in succession to the machine for processing mail.

A sheet transfer device or an insertion device per se transfers successive sheets that it receives and inserts them into respective envelopes at the insertion station. An ejection device for ejecting filled envelopes ensures that each filled envelope is removed so that a new insertion operation can take place.

Control mechanisms control these various devices to operate synchronously. In order to satisfy current requirements, these control mechanisms must be capable of operating at high insertion rates with the various devices all operating with a high degree of reliability.

French patent document No. FR 84 14141 in the name of the present Applicant and entitled "A device for inserting a bundle into an envelope" already describes a device for inserting each sheet that it receives into the envelope which is then present in the insertion station.

In this prior device, a sheet feed path for feeding separate sheets to be put successively into envelopes feeds a fixed sheet inlet station. This sheet feed path includes a fixed sheet-receiving tray which extends the sheet feed path and which is disposed at a distance from and substantially level with the insertion station. A serving tray which is mounted to move back and forth and which is referred to as a carriage serves to transfer successive sheets from the fixed inlet station to the insertion station, and to insert them into the envelopes. The carriage is driven along its "go" stroke and its "return" stroke between two limit positions, referred to as a "rest" position in which it is beneath the inlet station and a "working" position in which it is partially engaged together with the sheet carried thereby inside the envelope present at the insertion station. Retractable pusher fingers are linked to the carriage and they form both an abutment for the sheet which they push during the "go" stroke of the carriage, and a retracted obstacle for the following sheet to be put into the next envelope during the "return" stroke of the carriage.

These retractable fingers are mounted on parallel support arms carried by the carriage and extending between the level of the inlet station and the level of the carriage. They are linked to the support arms by individual hinges leaving a degree of longitudinal play along the support arms. They are also coupled to the carriage and associated with means for causing them to move in translation along said longitudinal play on their corresponding support arms in one direction and the other direction on passing from the "go" stroke to the "return" stroke and vice versa, and they are put simultaneously into the raised position or into the retracted position i.e. to constitute an abutment for the sheet currently being inserted or a retracted obstacle for the following sheet to be put into the next envelope, depending on the direction of the current stroke, of the carriage.

Such an insertion device having retractable pusher fingers which are put into a raised position during the "go" stroke of the carriage provides reliable engagement with a sheet present at the inlet station for insertion into an envelope. These same pusher fingers, when retracted for the "return" stroke of the carriage enable a new sheet to arrive at the inlet station while the preceding sheet is being transferred and during the "return" stroke of the carriage. They thus contribute to obtaining a very high insertion rate. However, they increase the complexity of the insertion device and the complexity of its control mechanisms, thereby considerably increasing the cost of a sheet insertion device.

The object of the present invention is to simplify such an insertion device and consequently to reduce its cost, but without thereby loosing the advantages of high insertion rates being possible with a high degree of operating reliability.

SUMMARY OF THE INVENTION

The present invention thus provides a sheet insertion device for inserting sheets into envelopes, and comprising:

a fixed insertion station per se, fed with empty envelopes which are separate from one another;

a fixed sheet inlet station including a fixed inlet tray, said station being at a distance from the insertion station and being fed with sheets which are separate from one another;

a sheet transfer and insertion tray referred to as a "carriage" which is driven in translation along a "go" stroke from a first position in which it is retracted beneath the fixed inlet tray to a second position in which it is at least partially engaged in the envelope present in the insertion station, and also along an opposite "return" stroke, said carriage being fitted with pusher fingers having forwardly-directed sheet grasping means for grasping the sheet present in the inlet station, said fingers projecting above the level of the inlet station in order to retain the sheet by their grasping means and to push it during said go stroke, wherein said pusher fingers and said front sheet grasping means are fixed relative to each other and are fixed relative to the carriage, with said forwardly-directed grasping means projecting just above the level of the inlet station in order to leave them free to pass beneath a sheet waiting in the inlet station during the return stroke of the carriage, and wherein the sheet insertion device further comprises holding-down fingers mounted above the inlet station and controlled to take up a holding-down position against the inlet station at least during the beginning of said carriage go stroke in order to force the sheet beneath said grasping means, thereby ensuring that the sheet is taken by said grasping means of each pusher finger, and also having a retracted position above the inlet station during the remainder of the go stroke and during the station free to be fed with a new sheet.

The device may also include sheet retaining fingers mounted at the front of the inlet station, and a set of levers coupling the sheet retaining fingers and the holding-down fingers to means for simultaneously causing the sheet retaining fingers to take up a retracted position beneath the inlet station when the holding-down fingers are down, and vice versa.

Said sheet retaining fingers may be adjustable in position at the front of said inlet tray and said inlet tray may itself be adjustable transversely to said retaining fingers.

BRIEF DESCRIPTION OF THE DRAWINGS

An embodiment of the invention is described by way of example with reference to the accompanying drawings, in which.

MORE DETAILED DESCRIPTION

Figure 1:
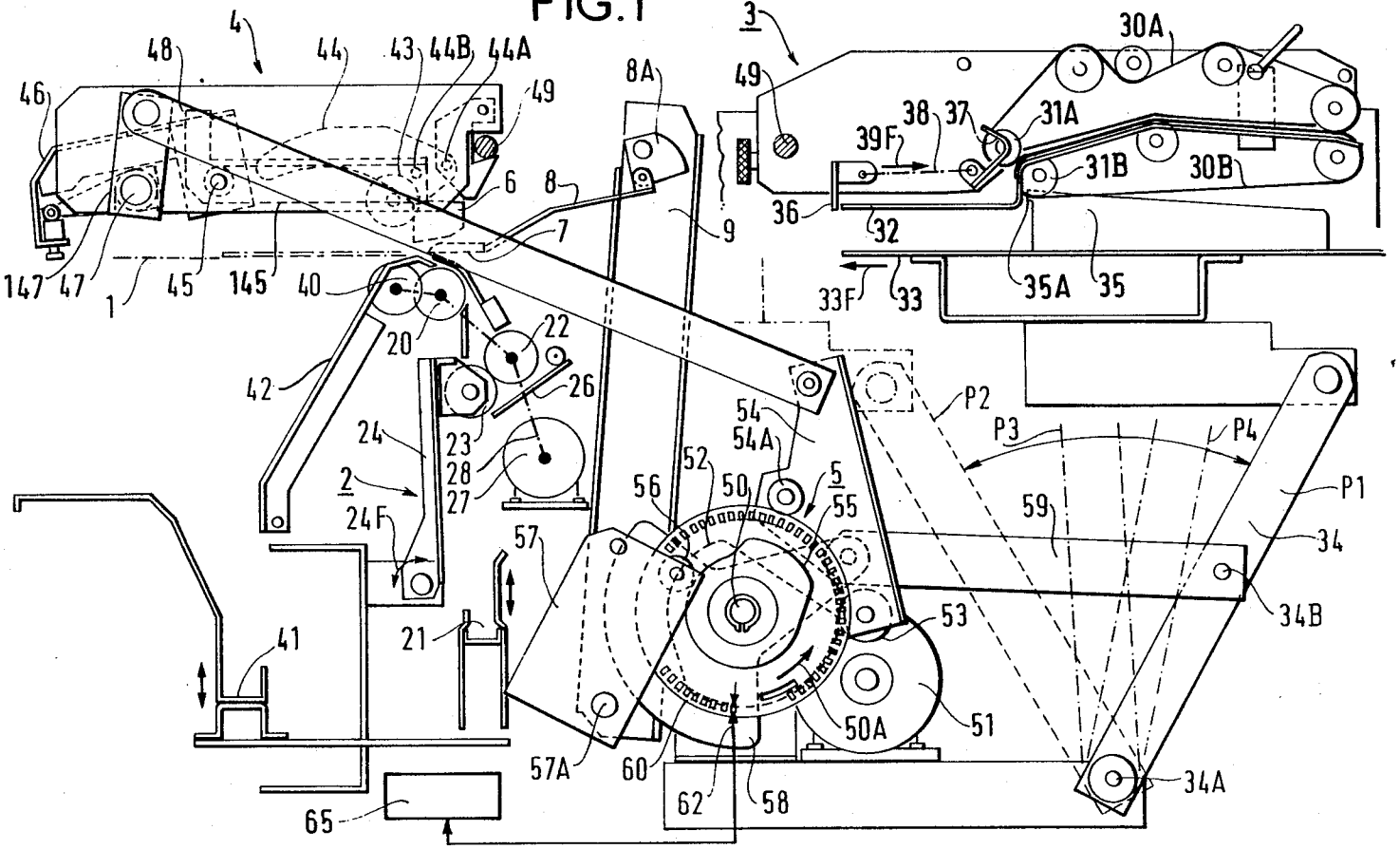
FIG. 1 is a diagrammatic overall view of a machine for processing mail and including a device in accordance with the invention for inserting sheets into envelopes.

FIG. 1 is a diagrammatic elevation view of a machine for automatically processing mail and including a device for inserting sheets into envelopes in accordance with the present invention. The overall structure of this machine is described with reference to FIG. 1.

The machine comprises:

a sheet insertion station 1 for inserting sheets into envelopes;

an empty envelope transfer device 2 for feeding the sheet insertion station with empty envelopes;

a sheet transfer device 3 for transferring and inserting sheets into the successive envelopes presented to the sheet insertion station, which station is also referred to as the sheet insertion device;

an ejection device 4 for ejecting filled envelopes, causing successive filled envelopes to be removed from the insertion station; and a control assembly 5 for controlling said devices 2, 3, and 4, causing them to perform defined control sequences relative to one another during each successive insertion cycle of the machine.

The sheet insertion station 1 is represented by a single dot-dashed straight line extending substantially tangentially to two wheels 20 and 40 (or two sets of wheels) which do not belong to said station per se, but which are disposed side by side beneath the inlet 10 to the plane of the insertion station. These wheels are described in greater detail below when describing the devices 2 and 4 to which they do, in fact, belong. The straight line segment defines the insertion plane for inserting sheets into envelopes The general organization of the empty envelope transfer device 2 is known, per se, and corresponds to the description of the Applicant's French patent application No. FR-86 07472, and entitled "A device for opening envelopes". Only a brief description of this device is incorporated in the description of the present machine.

The empty envelope transfer device 2 feeds the insertion station with envelopes and also opens the flaps of the envelopes it transfers to the insertion station. It comprises an empty envelope arrival chute 21 which extends substantially horizontally and which is fed with empty envelopes that are separate from one another. These separate empty envelopes come from an unstacker mounted at the envelope outlet from a magazine (not shown). The envelopes are conveyed along said chute 21 which couples the said unstacker to the transfer device 2. In the chute 21, the envelopes are received with their top edges, i.e. the edges from which their flaps are folded, running along the bottom of the chute.

The device 2 includes an extractor drive wheel 22 and an associated extractor backing wheel 23 disposed above the chute 21 for receiving therebetween the bottom edges or the bottom portions of the successive upsidedown envelopes present in the chute and conveyed to said drive wheels. The device also includes an outlet drive wheel which is constituted by the above-mentioned wheel 20 mounted level with the inlet to the insertion station 1. This outlet wheel 20 is mounted above the wheels 22 and 23 and serves to impart an appropriate curvature to each envelope leaving the device 2 for enabling the envelope to penetrate into the insertion station. In practice, it is associated with a backing pressure wheel which is not shown in order to avoid overcrowding the figure.

In this empty envelope transfer device 2, the extraction backing wheel 23 is mounted on a pivot arm 24 which is controlled by an electromagnet (not shown) to move in the direction of double-headed arrow 24F between a rest position where it is at a distance from the extraction wheel 22 and an extraction position in which it presses against the extraction wheel. In the rest position of the extraction backing wheel, the mid-axis of the chute is substantially tangential to said extraction backing wheel. In the extraction position of the extracting backing wheel, the mid-axis of the chute intersects the periphery of the backing wheel so that an envelope pinched between the wheels 22 and 23 is curved. A plate 26 mounted beneath the extraction wheel serves to retain the partially open envelope flap, thereby unfolding it and fully opening the envelope while the envelope is being extracted from the chute 21. The chute 21 is a channel section member having one of its flanges truncated. The back of the envelope together with the partly opened flap faces the larger of the two flanges of the chute. The chute helps impart curvature to the envelope since the envelope can bow out over the shorter flange, simultaneously opening its flap further.

The wheel 40 and the extraction and outlet wheels 22 and 20 are driven by a motor 27. Dot-dashed lines 28 illustrate the coupling between the motor 27 and the wheel 40 and the wheels 22 and 20. This motor is controlled electronically from the control assembly 5 as described in greater detail below.

The insertion device 3 for inserting sheets into envelopes is fed with separate sheets via a sheet feed path defined by two sets of endless belts 30A and 30B. The belts are kept under tension between guide wheels and only the two terminal guide wheels at the outlet from the feed path are referenced, 31A and 31B. These two references are also used to designate the outlet from the feed path for separate sheets.

The sheet feed path is fed by a folding machine which is itself optionally coupled to a bundling machine (not shown) and disposed upstream or downstream therefrom. The sheets delivered in this way for insertion into the envelopes may be constituted by single folded sheets, or by a plurality of sheets which may be folded either before or after being bundled together.

This device 3 includes a fixed sheet inlet station constituted by a fixed tray 32 for receiving sheets and mounted beneath the outlet 31A, 31B and extending said outlet towards the insertion station. The fixed tray 32 is disposed slightly above the plane of the insertion station 1 and is at a distance from said station.

The device 3 also includes a serving tray 33 situated substantially in the same plane as the insertion station and serving to transfer and insert sheets into envelopes. The serving tray 33 is mounted beneath the fixed tray as a moving carriage capable of back-and-forth motion along arrow 33F. It has a control lever 34 coupled thereto for the purpose of driving it between a first limit position in which it is practically retracted beneath the fixed tray 32, and a second limit position in which it is partially inside the insertion station 1 and is inserted in the envelope then present in said station. The first position corresponds substantially to that shown in solid lines, and the second position is partially indicated by dot-dashed lines.

The serving tray or carriage 33 carries a pair of pusher fingers 35 which are integral with the tray 33, which are fixed, and which are upstanding on the tray. The pusher fingers 35 also project slightly above the plane of the fixed tray 32 which has two longitudinal windows for receiving them (not shown in FIG. 1) with said windows being open at both ends of the fixed tray. Each of the pusher fingers 35 has a leading rib 35A which passes over the sheets in order to ensure that they are taken by and pushed by the fingers 35 when the carriage 33 moves towards the insertion station as illustrated by arrow 33F. The nib 35A on each pusher finger is fixed and is obtained by appropriately shaping the profile of each finger. It runs flush immediately above the level of the fixed tray 32.

The device 3 also includes sheet retaining fingers 36 mounted above the fixed tray 32 at the front thereof, and holding-down fingers 37 at the rear of the fixed tray immediately downstream from the outlet 31A, 31B from the sheet feed path. These fingers 36 and 37 are coupled by a set of levers represented by dot-dashed lines and given an overall reference 38. This set of levers 38 is itself coupled to a controlling electromagnetic (not shown) acting as symbolized by arrow 39F in order to cause the retaining fingers 36 and the holding-down fingers 37 to pivot simultaneously, with the fingers moving together and in the same direction from their normal position in the absence of a control signal. As shown, in said normal position, the retaining fingers 36 constitute a transverse obstacle at the front of the fixed tray 32 while the holding-down fingers 37 are retracted above the fixed tray in order to allow a sheet to arrive freely beneath the holding-down fingers and be retained on the fixed tray 32. They remain in this position except when the sheet is being transferred from the fixed tray 32 to the carriage. This set of levers 38, and the control of the fingers 36 and 37 are described in greater detail below.

The ejector device 4 for ejecting filled envelopes comprises the above-mentioned wheel 40 mounted together with the wheel 20 beneath the inlet to the insertion station, with said wheel 40 being an ejection drive wheel. Like the wheel 20, the wheel 40 is constituted, in practice, by a set of wheels mounted on a common shaft. The ejector device 4 also includes a mechanism for tilting envelopes to be removed from the insertion station (not given on overall reference), an envelope reception chute 41, and a guide 42 between the wheel 40 and the chute 41.

The guide 42 is mounted sloping beneath the insertion station and serves to provide coupling between the insertion station (or more precisely its envelope inlet level with the wheel 40 ) and the chute 41 when the tilting mechanism acts on an envelope. This chute 41 which is also beneath the insertion station is horizontal and extends parallel to and at a small distance from the chute 21 belonging to the station 2 for transferring empty envelopes. Filled envelopes leaving the insertion station are received with their bottom edges being received in the bottom of the chute 41. Like the chute 21, the chute 41 is a channel section member having a truncated flange, and it is equipped along its length with wheels (not shown) for driving the filled envelopes it receives in the direction opposite to that in which empty envelopes are driven along the chute 21.

Both of the chutes 21 and 41 are adjustable in level relative to the plane of the insertion station 1 in order to take account of different types of envelope to be filled. A double-headed arrow associated with the chutes, but not referenced, illustrates this vertical adjustment.

The mechanism for tilting filled envelopes comprises a backing wheel 43 associated with the ejector wheel 40 and pivotally mounted, together with pivoting tilting fingers 44.

Individual L-shaped crank levers hinged to a common fixed axis 45 and similar to the single one 145 of these levers to be illustrated, control the components of the tilting mechanism. The hinge axis 45 passes through them substantially level with the junction between the two arms of their L shapes. The backing wheel 43 is mounted at the end of the long arm of its L-shaped lever. The tilting fingers 44 are hinged about a fixed axis 44A and are also individually coupled to the ends of the long arms of their levers by control studs 44B.

These levers such as 145 are caused to move simultaneously about the hinge axis 45 by a control lever 46. The control lever 46 is itself controlled by two other levers which are fixed to a shaft 47 and which are designated overall by reference 147. These levers 147 couple the control lever 46 to a control link 48. The link 48 is actuated by the control mechanism 5.

The lever 46 is an upsidedown generally channel-section member. One of the ends of the levers 147 is received in abutment in the end portion of the lever 46 which is at the end of the device 4, thereby coupling the lever 46 to the link 48. The short arms of the L-shaped levers such as 145 are also received in abutments in the opposite end portion of the lever 46 inside the device 4 for the purpose of controlling the L-shaped levers.

The ejection device 4 is carried by the hinge shaft 47 and on a support shaft 49 to which it is normally locked, but from which it can be unlocked by a manual operation. This ejector device 4 is not described in greater detail below. The precise arrangement of its components and their control means is described more completely in the Applicant's patent application filed the same day as this application and entitled "A device for ejecting filled envelopes, and an insertion machine using said device".

In FIG. 1, the shaft 49 is shown twiceover; once in the facing end portions of the ejector device 4; and once the sheet insertion device 3. In practice, it is constituted by a single shaft, but the sheet insertion device which is also carried by said shaft has been offset to the right in FIG. 1 in order to clarify FIG. 1.

The machine further includes anti-return lugs 6 for preventing the return of a sheet inserted in an envelope present in the insertion station 1. Properly speaking, these anti-return lugs belong to the insertion device 3, however, they are mounted for control purposes as though they belonged to the ejection device 4. Like the tilting elements, they pivot under the control of the link 48 as transmitted by the lever 46 to the individual L-shaped levers such as 145, and they are fixed to the ends of the long arms their L-shaped levers.

These anti-return lugs 6 are above the insertion station 1. They face the envelope inlet 10 to said insertion station and they are at the end of the insertion device 3.

In addition to the devices 2, 3 and 4, and the anti-return lugs 6 mounted in the device 4, the machine illustrated in FIG. 1 includes fingers 7 for opening the body of an envelope present in the insertion station.

Like the anti-return lugs 6, these opening fingers 7 belong to the insertion device 3. They are mounted in front of the retaining fingers 36 and are disposed immediately in front of the envelope inlet to the insertion station. They are formed at the ends of individual supports 8 whose opposite ends are coupled by hooking tabs 8A to a common actuator lever 9.

The control assembly 5 essentially comprises a drive shaft 50 having cams mounted thereon and driven in the direction of arrow 50A by a control motor 51. This shaft 50 has a first cam 52 for controlling the ejection device 4 and referred to as the ejection cam. An ejection wheel 53 carried by a hinged lever 54 bears against the ejection cam 52. The lever 54 is hinged about a fixed axis 54A and is also coupled to the link 48 for controlling the ejection device under its control.

The same shaft 50 also carries a second cam 55 for controlling the opening fingers 7, with said cam being referred to as the envelope body opening cam. An opening control wheel 56 bears against the opening cam 55 and is carried by a support lever 57. This lever 57 is coupled to the lever 9 at a fixed hinge axis 57A and it controls the lever 9 to actuate the opening fingers 7.

The shaft 50 also controls a connecting link and crank system whose crank 58 constitutes a flywheel fixed to the shaft and drives a connecting link 59. This link 59 is itself hinged to the lever 34 which controls the carriage 33 in order to move it back and forth. The lever 34 has one of its ends coupled to the carriage and has its other end coupled to a fixed hinge axis 34A. It is hinged substantially in the middle to the link 59 by a hinge 34B.

With respect to this carriage drive, references P1 and P2 designate the substantially extreme positions taken up by the lever 34 for controlling the carriage 33, while references P3 and P4 mark two special intermediate positions.

The same shaft 50 also carries a disk 50 for encoding the angular position of the shaft.

A photoelectric cell referenced 62 delivers this angular position. The disk 60 has a plurality of regularly spacedapart identical openings which are detected by the sensor 62 in order to deliver successive angular positions of the shaft 50. The disk 60 also has a single, larger opening which is also detected by the sensor and serves to define a reference position. These openings are not referenced in FIG. 1, and they are described in greater detail below. The sensor 62 is coupled to a counter 65.

Figure 2:
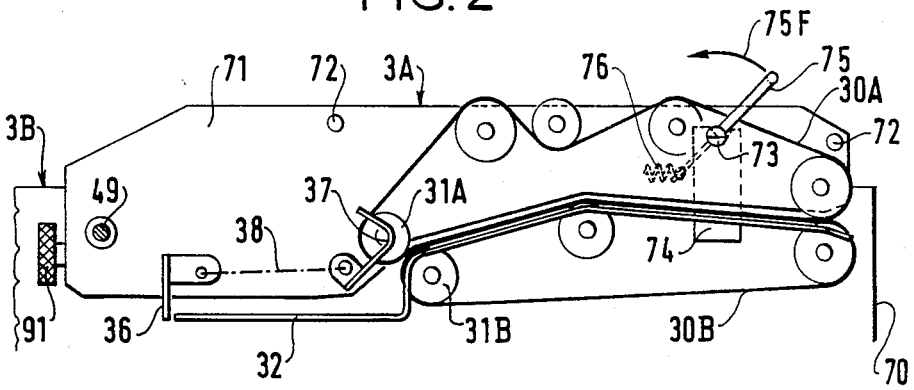
FIGS. 2 and 3 are two highly diagrammatic views of the sheet insertion device of FIG. 1 showing its overall structure.
Figure 3:
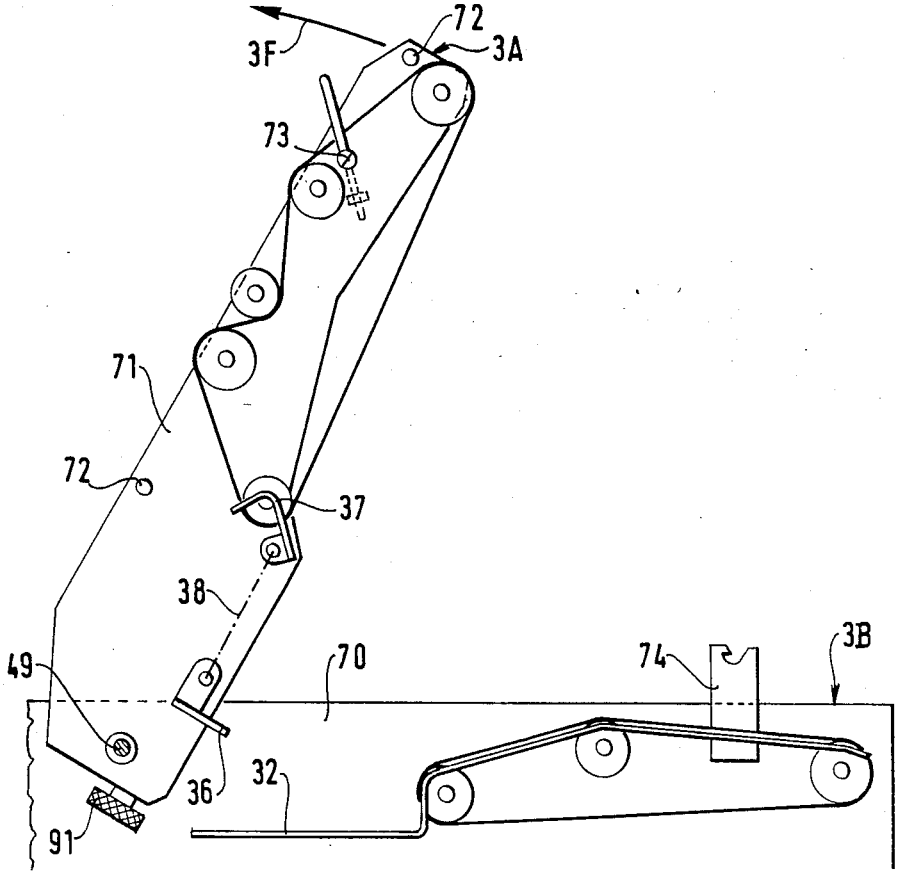

FIGS. 2 and 3 are two diagrammatic views of the sheet insertion device 3 of FIG. 1 given to show its overall structure. Items already described with reference to FIG. 1 are designated therein by the same references.

FIGS. 2 and 3 show that the sheet insertion device 3 is mounted in a chassis 70 with a portion of its components being pivotable therein. The top of the chassis is open, and it extends towards the left of FIGS. 2 and 3 where it also receives the ejection device 4 of the machine shown in FIG. 1.

Within the chassis 70, the sheet insertion device 3 is organized in the form of two subassemblies referred to as the top portion 3A and the bottom portion 3B of the device 3, with the top portion 3A pivoting as shown by arrow 3F about the support shaft 49 in the chassis 70. The top belts 30A which guide and drive the sheets on the sheet feed path, the retaining fingers 36, and the holding-down fingers 37 and their set of control levers 38 all belong to the top portion 3A. The bottom belts 30B of the sheet feed path, the fixed plate 32, and the fitted carriage (not shown) all belong to the bottom portion 3B, and are mounted directly in the chassis 70.

The top portion 3A is locked to the bottom portion 3B in FIG. 2, and is opened in FIG. 3. It is mounted on two cheek pieces 71 both of which are visible in FIG. 5. These cheek pieces are held to each other by spacer bars such as 72. These cheek pieces are pivotally mounted on the shaft 49 which passes through one of their ends; they carry another support shaft 73 which is locked within two hooking lugs forming a yoke 74 and fixed on the side walls of the chassis in order to receive the shaft 73.

This supporting shaft 73 passes freely through the cheek pieces substantially at their opposite end. A handle 75 is fixed to the shaft 73. It can be actuated in the direction of arrow 75F in order to rotate the shaft 73 about its own axis against the effect of a return spring 76, thereby unlocking the shaft 73 from the hooking lugs 74. In order to lock and unlock the support shaft 73 relative to the hooking lug 74, said shaft has a flat (not referenced ) at each of its ends for disengaging the support shaft 73 from the hooking lugs 74 merely by rotating said shaft 73.

This structure of the device 3 in two portions 3A and 3B, with the portion 3A being unlockable from and openable relative to the portion 3B which is mounted in the chassis, provides access to the sheet feed path and to the fixed inlet tray. This access makes it possible to clear any accidental jamming which may take place during machine operation.

Figure 4:
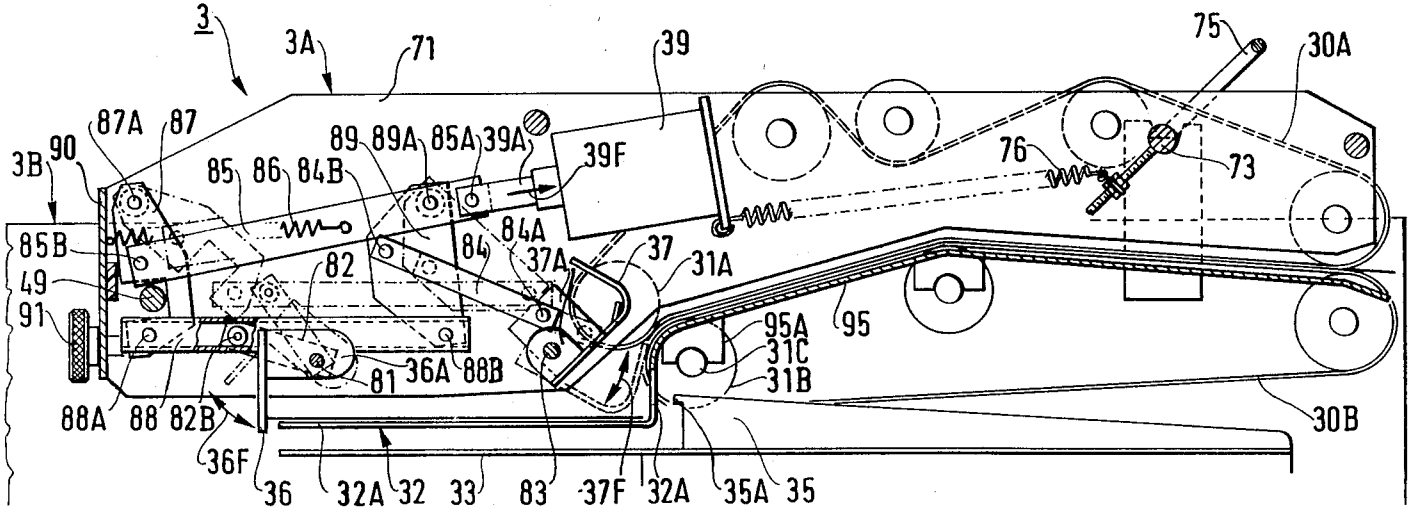
FIG. 4 is a fragmentary section view through the FIG. 1 sheet insertion device, shown on a larger scale than FIG. 1.
Figure 5:
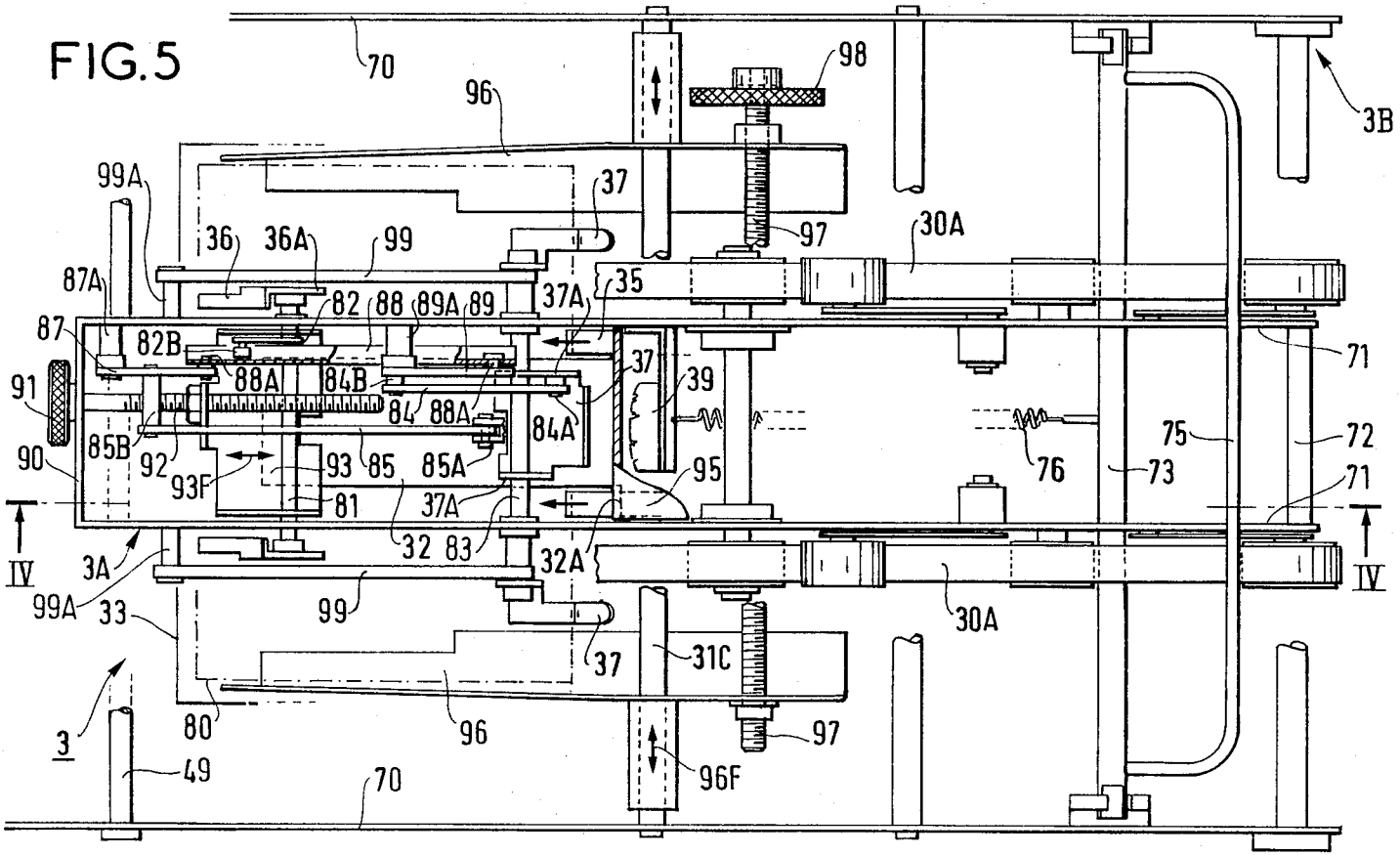
FIG. 5 is a fragmentary plan view of the FIG. 4 sheet insertion device shown with its components in position for transferring a sheet for sheet insertion purposes.

The structures of the sheet insertion device 3, and in particular the structure of its top portion 3A, is described in greater detail with reference to the views given in FIGS. 4 and 5 which show the details, in particular, of the set of levers 38 for controlling the retaining fingers 36 and the holding-down fingers 37. In FIG. 4 which is a section view on line IV-IV of FIG. 5, the retaining fingers 36 and the holding-down fingers 37 are shown in solid lines in their normal positions in the absence of any command being transmitted thereto, and dashed lines are used to show their sheet transfer positions, which positions are taken up in response to a command applied thereto via the set of levers 38. In FIG. 5, for reasons of clarity, these fingers are shown only in said second position for transferring a sheet present therein and referenced 80.

The retaining fingers 36 and the holding-down fingers 37 are moved to their transfer position by an electromagnet 39 (which is shown only in FIG. 4), whenever said electromagnet is itself activated. The set of levers 38 provides coupling between the electromagnet and the retaining fingers and the holding-down fingers so as to transmit said command to them simultaneously or so as to enable them to return simultaneously to their normal positions.

The retaining fingers 36 are linear in profile and each of them has an end bar 36A serving to hold it to one or other of the two ends of a support shaft 81. Said support shaft 81 passes through the two cheek pieces 71, with the two retaining fingers carried thereby lying outside the two cheek pieces. This support shaft 81 is also mounted to be adjustable relative to the front of the fixed tray 32 in a manner described below. A lever 82 referred to as the retaining finger lever has one of its ends fixed to the support shaft 81 in order to pivot the retaining fingers in the directions of double-headed arrow 37F of FIG. 4.

The holding-down fingers 37 are in the form of respective bent rods each having an end tab 37A on one of its two edges for the purpose of fixing it to a support shaft 83. The shaft 83 passes through the two cheek pieces 71 and has a holding-down finger at each of its ends, said fingers lying outside the cheek pieces, and said shaft also having a third, wider, holding-down finger in its middle between the two cheek pieces. A lever 84 referred to as the holding-down finger lever has one of its ends hinged at 84A to one of the two fastening tabs of the central of the holding-down finger and serves to pivot all three holding-down fingers in the directions of double-headed arrow 37F shown in FIG. 4.

An electromagnet link 85 has one of its ends 85A hinged to the plunger 39A of the electromagnet 39. It has a hinge 85B at its opposite end which couples it to a first control lever 87 at a point substantially halfway therealong.

This first control lever 87 is pivotally mounted at one of its ends about a fixed support shaft 87A carried by one of the cheek pieces 71. Its opposite end is hinged to one of the ends of a coupling beam 88 via a hinge 88A. The opposite end of the retaining finger lever 82 is coupled to the beam 88 by means of a wheel 82B carried by the lever 82 and held in the beam 88. To this end, the beam 88 is a channel beam as can be seen from the fragmentary section of said beam shown in FIG. 4 around the wheel 82B which it receives. A second control lever 89 has one of its ends hinged to the second end 88B of the beam 88. Like the first control lever 87, it has its other end pivotally mounted about a fixed shaft 89A. The holding-down finger lever 84 has its second end coupled by a hinge 84B to an intermediate region of said second control lever.

In this set of levers, the electromagnet link 85 and the beam 88 extend substantially along the length of the top portion 3A above and in front of the fixed tray 32, at different levels. The first and second control levers 87 and 89 extend generally up and down said top portion 3A, at least so long as no command is delivered by the electromagnet. A spring 86 fixed to a midportion of the link 85 and to the end of the cheek pieces (which end is closed by an add-on plate 90), urges the set of levers so that the first control lever 87 comes into abutment against the plate 90 in the absence of any command from the electromagnet. The control lever 87 is shaped so as to avoid engaging the support shaft 49.

The command exerted by the electromagnet is illustrated by arrow 39F in FIG. 4. This command is transmitted to the set of levers to cause the retaining fingers 36 to pass from their position in which they constitute a transverse obstacle at the front of the fixed tray to a retracted position, while simultaneously causing the holding-down fingers 37 to go from their raised position above the fixed tray to a holding-down position. This command serves firstly to allow a sheet 80 then present on the fixed tray 32 to be freely transferred to the carriage 33, and secondly to cause said sheet to be engaged beneath the leading nibs 35A of the pusher fingers which are then advancing together with the carriage 33. These fingers return to their normal positions shown in solid lines in FIG. 4 as soon as the sheet has been fully transferred onto the carriage 33 so as to make room for the following sheet to arrive on the fixed tray beneath the holding-down fingers and to enable the following sheet to be retained on said fixed tray by the retaining fingers.

The retaining fingers 36 are adjustable in position at the front of the fixed tray 32 by acting on a knurled knob 91 situated in front of the closure plate 90 between the cheek pieces 71. With reference to FIG. 5, it can be seen that the knurled knob 91 controls a screw 92 extending longitudinally in the space between the cheek pieces 71. This screw carries a support bracket 93 which occupies substantially the entire width of the space between the cheek pieces 71 and which has the support shaft 81 of the retaining fingers mounted therein. Although not shown, it will be understood that said support shaft 81 which moves together with the support bracket 93 back and forth along arrow 93F moves through two longitudinal slots provided in the cheek pieces. This adjustment of the positions of the retaining fingers 36 at the front of the fixed tray 32 makes it possible to process sheets of different formats.

In addition to the retaining fingers 36 which are adjustable as a function of one of the dimensions of the sheets, FIG. 5 shows that the fixed tray 32 is also adjustable in the bottom portion 3B of the device 3 in order to adapt to the other dimension of the sheets, so as to accept sheets of numerous different formats.

The fixed tray 32 is formed in front of the outlet 31A–31B of the sheet feed path. It comprises a central portion referenced 32. This central portion is part of a plate 95 which is shaped to follow the sheet feed path and which is mounted between the two belts 30B in the bottom portion 3B and which is held in place by lateral tabs 95A, in particular by the shafts of the wheels, e.g. the shaft 31C of the terminal wheels 31B at the outlet from the path. At the wheels 31B, the plate 95 is curved and then bent through a right angle in order to extend forwards beneath the outlet 31A–31B and thus form the central portion of the fixed tray. A lateral cut-out is provided level with each of the wheels 31B in order to define each of windows 32A for allowing the pusher fingers 35 to pass along the length of the fixed tray 32 when the carriage 32 is advanced. The fixed tray 32 also includes, on either side of its central portion, two angle section bars 95 which are associated with said central portion in order to delimit the width of the resulting inlet trays. These two bars 96 are carried by the shaft 31C of the terminal wheels of the portion 3B and they are slidable along said shaft in the direction of double-headed arrow 96F, and they are also carried on a common threaded rod 96 having oppositely handed threads in order to move the angle bars in opposite directions along said rod. A knurled knob 98 rotates the rod 97 and thus adjusts the gap between the angle bars 96.

Thus, each time the format of the sheets to be inserted into the envelopes is changed, the position of the retaining fingers 36 at the front of the fixed tray is adjusted and simultaneously the gap between the two side angle bars 96 is also adjusted, as the function of the dimensions of the new format.

The sheet transfer and insertion carriage 33 is also adjustable in length and in width in order to adapt to various different sheet formats. The way it is organized to allow such adjustments to be performed corresponds to that described in above-mentioned French patent document No. FR-A-84 14141, and is therefore not described further below.

In order to ensure that the sheets which are received on the fixed tray 32 and are then transferred onto the carriage 33 prior to being transferred together with the carriage towards the insertion station remain substantially flat throughout, two vertical guides 99 (FIG. 5) are mounted on the outer sides of the cheek pieces 71. These guides face the fixed tray 32, are at a relatively small distance from said tray, and project beyond the front of the tray. They are carried firstly by the shaft 83 which carries the holding-down fingers 87, on which shafts they are free to rotate, and secondly they are carried by a respective holding shafts 99A fixed to the corresponding cheek pieces 71.

Figure 6:
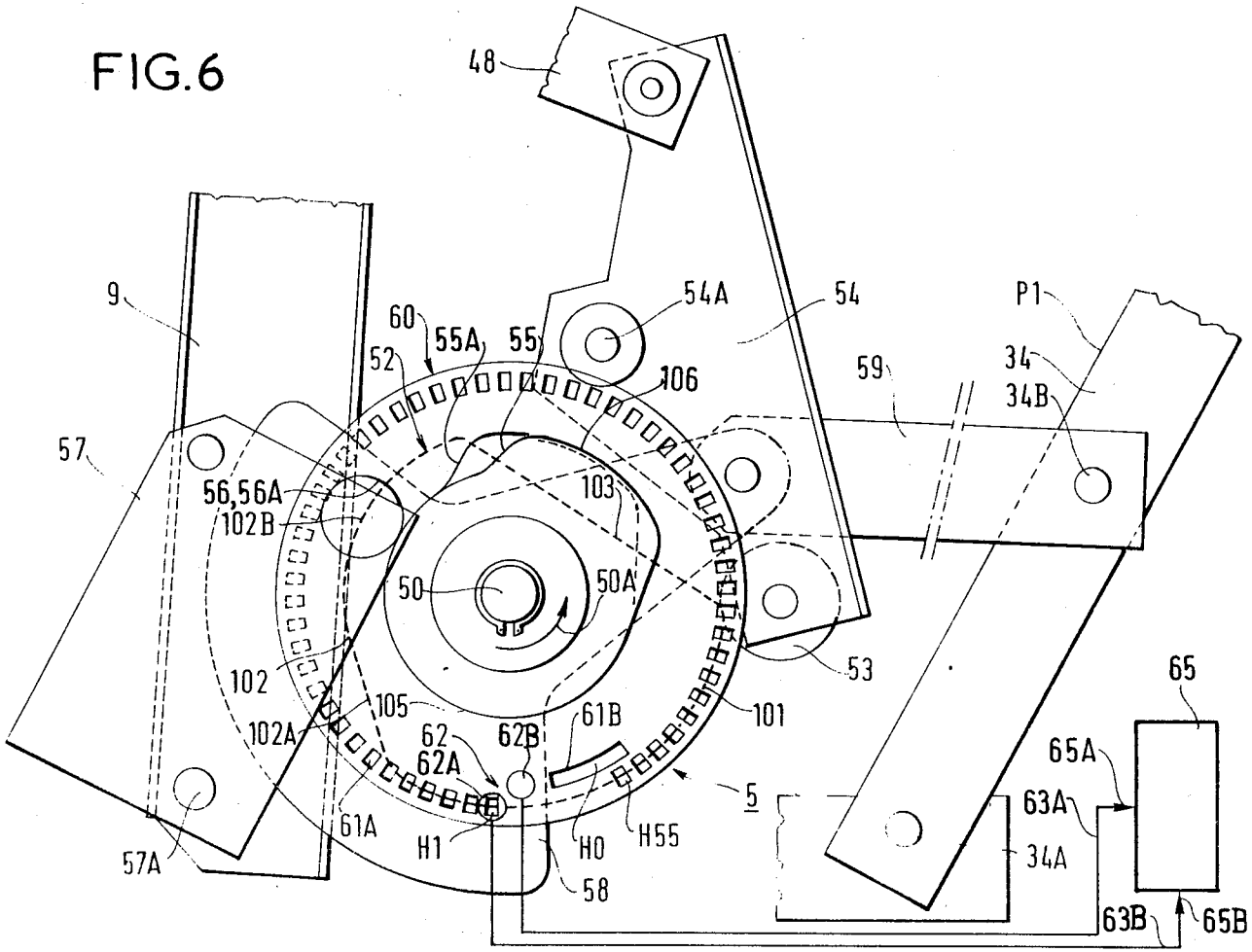
FIG. 6 is a view of the control device of the FIG. 1 machine shown on a larger scale.

The sheet insertion device 3 and the other devices used in the machine shown in FIG. 1 are controlled by the control assembly 5 which is shown in greater detail in FIG. 6.

In FIG. 6, items which have already been described with reference to FIG. 1 are designated by the same references.

The periphery of the ejection cam 52 mounted on the driving cam shaft 50 and against which the control wheel 53 is pressed is essentially constituted by three successive distinct portions referenced 101, 102 and 103, with each portion occupying a sector of about 120°. The portion 101 is circular and is the radially outermost portion of the periphery. The portion 103 constitutes a flat on the ejection cam and is the portion which projects least, radially. The portion 102 is intermediate, and is itself constituted by two portions of similar length, having a substantially linear portion 102A adjacent to the portion 101, and a substantially circular portion 102B adjacent to the portion 103. The portion 101 is referred to as the "rest" portion, the portion 103 is referred to as the "ejection" portion, and the portion 102 is a transition portion between the portions 101 and 103, with said terms being derived from the control effects which said portions transmit to the ejection device via the wheel 53, the lever 54, and the link 48.

The flywheel 48 rotates with the shaft 50 which drives it. The system comprising the link 59 and the lever 34 transforms this rotary motion of the flywheel 58 into alternating motion which is transmitted to the carriage of the sheet insertion device 3, imparting a variable speed to the carriage along its "go" stroke towards the insertion station and also along its return stroke.

The periphery of the cam 55 for opening the envelope bodies and mounted on the drive shaft 50 has the control wheel 56 pressed thereagainst, and essentially comprises two portions 105 and 106 both of which are semicircular, but having different radiuses. The portion 105 is considerably longer than the other portion 106, however its radius is smaller than that of the portion 106. These portions 105 and 106 are separated by substantially linear transitions for rapidly changing the imparted control position. The portion 105 is the "rest" portion and the portion 106 is the envelope "body-open" portion, with said terms being related to the effects they transmit to the opening fingers via the wheel 56 and the control lever 9.

In order to take account of the various different possible formats of sheet to be put into corresponding envelopes, which may also be of various different formats, the control lever 9 is also capable of being pivoted by an auxiliary cam 55A which is analogous to the cam 55 and which is also mounted on the shaft 50, but which imparts a slightly advanced control action to the lever 9. The associated cam follower wheel 56A of said cam 55A is selectively actuated to occupy a position where it presses against the cam 55A or a position where it is retracted away from the cam 55A under the control of an electromagnet provided for this purposes and not shown. When the wheel 56A is in its retracted position, only the cam 55 acts on the lever 9, whereas when the wheel 56A is pressed against its cam 55A, then both cams 55 and 55A act on the lever 9. The beginning of this combined action is determined by the cam 55A whereas the end of the combined action is determined by the cam 55. Advantageously, the two cams 55 and 55A are mounted on either side of the coding disk 60.

The coding disk 60 which is also mounted on the drive shaft 50 and which is caused to rotate together with the cams 52, 55, 55A, enables the relative positions of the cams and the flywheel 58 to be accurately determined for the progress of the mechanical controls they provide. Also, with respect of the various control sequences defined relative to one another for each insertion cycle, the disk makes it possible to ensure that the sequences under mechanical control take place at the appropriate times relative to sequences under electronic control, which sequences are controlled by the sensor 62 and the counter 65 on the basis of the coding disk 60 of the control mechanisms.

To this end, the disk 60 has a series of small openings such as 61A formed at a regular pitch round nearly all of its periphery except for a small gap having no such openings. The disk 60 is shown as having 55 small openings 61A and the small gap corresponds to 5 missing openings. The sensor 62 comprises two sensors, with two emitting cells associated with two respective receiving cells. One of the sensors 62A in this pair of sensors is mounted in association with the small openings 61A. References H1 and H55 at the periphery of the disk and facing the end most openings constitute the end most clock signals generated when all of the illustrated 55 small openings 61A are detected as they pass the sensor 62A during one complete rotation of the disk 60 and the shaft 50. Said sensor 62A is coupled to count input 65A of the counter 65.

The disk 60 also has a long opening 61B which is formed slightly further in from the edge of the disk than the small openings 61A and which extends, at least in part, level with the gap having no openings 61A. The second sensor 62B of the pair of sensors 62 is mounted to detect said longer opening 61B.

Each time the long opening 61B passes in front of the second sensor 62B of the pair of sensors 62, the second sensor 62B generates a clock signal reference H0 representative of a reference or rest angular position of the machine. This second sensor is shown as being coupled to a reset-to-zero input 65B of the counter 65. This clock signal H0 corresponds to a small number of signals such as H1, H2, H3, ..., H55, and has a duration of between 2 and 5 of said signals, in order to provide a range which is large enough to enable the shaft 50 to come to rest if the machine is to stop.

As shown in FIG. 6, it is advantageous for the longer opening 61B to extend level with the end most small opening 61A giving rise to the signal H55 and to continue therefrom over a portion of the gap having no small openings 61A. In this case, said portion corresponds to 3 of the 5 missing openings. The sensor 62B is offset angularly relative to the sensor 62A by a corresponding amount, i.e. by two steps of the clock H1 to H55. This offset compensates for the longer opening 61B not being centered over the entire gap having no openings 61A. It also serves to facilitate mounting the two sensors by using optical fibers 63A and 63B coupling two detector cells which are remote from the disk 60 to two emitting cells in order to detect the passages of said openings, while avoiding interference between either of the emitting cells and the fiber associated with the other emitting cell.

By virtue of this disposition, when the sensor 62A provides a clock signal H55, the longer opening 61B is still not level with the sensor 62B. However, as the shaft continues to rotate, after the clock signal H55 is over, the longer opening 61B reaches the sensor 62B and the counter 65 is reset to zero. Similarly, by the time the sensor 62A gives rise to a new clock signal H1, the long opening 61B has left its sensor 62B so that the clock signal H1 and the following signals H2, . . . , H55 are counted by the counter 65.

The essential operating sequences of the machine are described below with reference to the clock signals delivered by the sensor 62 and the associated counter 65, which clock signals are mentioned below for an insertion cycle performed by one complete turn of the driving cam shaft 50.

Sequence 1—carriage advance sequence

This sequence corresponds to clock signals H0 to H28, with the sheet beginning to be inserted into the envelope at ZH14 and with the sheet being fully inserted in the envelope at H28, said insertion being provided by the mechanical commands transmitted to the lever 34, by the rod and crank system 59, 58. The following two sub-sequences also take place during said sequence 1.

A first sub-sequence in which the sheet is transferred from the fixed inlet tray 32 to the carriage under electronic control based on the sensor 62 and the counter 65 and taking place from H0 to H14 with the retaining fingers 36 being retracted and the holding-down fingers 37 being lowered.

A second envelope body opening sub-sequence controls mechanically by the cam 55 or by the cams 55 and 55A, takes place from H8 to H21 for small format envelopes and from H5 to H21 for large format envelopes.

Sequence 2—sheet in envelope retaining sequence

This sequence is controlled mechanically by the cam 52 from signals H24 to H54. During this sequence the anti-return lugs 6 are in the low position.

Sequence 3—carriage return sequence

This sequence runs from signal H28 to signal H0, with the carriage being fully withdrawn from the envelope as from H42. It is mechanically controlled by the rod and crank 59–58.

Sequence 4—envelope ejection and feed sequence

This sequence runs from H41 to H5 and comprises two subsequences:

A first, tilting sub-sequence which rapidly lowers the envelope tilting components form H41 to H44, after which these components are held down from H44 to H53, and they are then raised from H53 to H0. This first sub-sequence is controlled mechanically by the cam 52.

A second, envelope transfer and ejection sub-sequence in which the drive wheels 20 and 40 are switched on, both for bringing in an empty envelope and for ejecting a filled envelope. This sub-sequence is under electronic control and it is triggered by the sensor 62 at signal H45 for small envelopes and at signal H47 for large envelopes.

Insertion cycles follow one another with their essential sequences interfitting or overlapping as the case may be. When the machine is started, insertion cycles are preceded by an initialization cycle in which an empty envelope is brought to the insertion station and a sheet is brought to the fixed inlet tray, and during which account is taken of parameters relating to the formats then concerned. When an overall stop command is given, the machine comes to rest in its reference position as indicated by the appearance of the signal H0.

Figure 7:
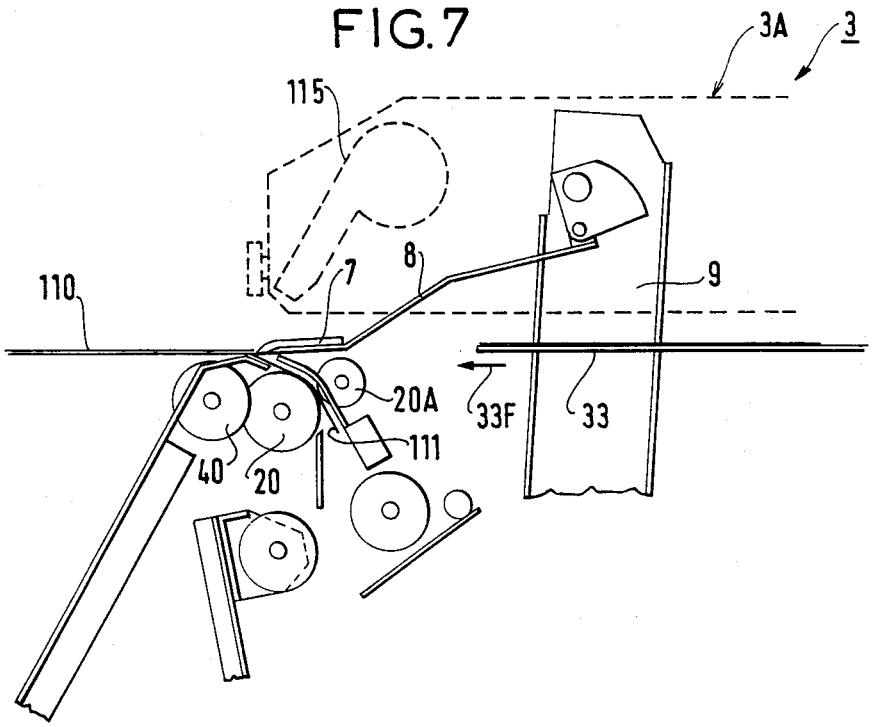
FIGS. 7 and 8 are diagrammatic views showing other items not shown in FIGS. 4 and 5 but belonging to the sheet insertion device, said items being shown in two other positions that they take up during operation of the sheet insertion device.
Figure 8:
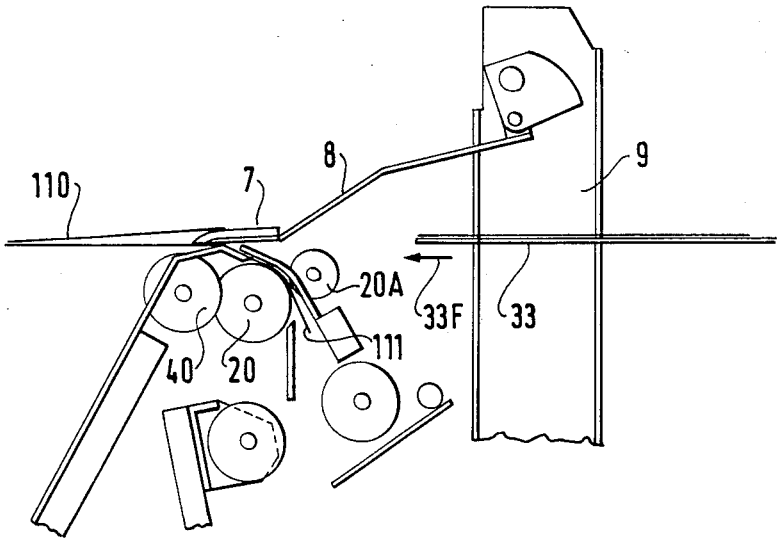

FIGS. 7 and 8 are given in addition to FIGS. 4 and 5 in order to show the operation of the sheet insertion device for inserting sheets into envelopes, during the carriage advance sequence, and to show the operation of opening an envelope body.

In FIGS. 7 and 8, an empty envelope 110 is shown held in the insertion station by its open flap 111 which is held between the outlet wheel 20 and its backing wheel referenced 20A of the device 2 for transferring empty envelopes (FIG. 1). The envelope 110 is stopped with the wheels 20 and 40 no longer be driven, and the carriage 33 has begun to advance along arrow 33F towards the envelope 110. The envelope 110 is assumed to be a small format envelope for receiving a small format sheet.

FIGS. 7 and 8 correspond to two operating stages lying between clock signals H5 and H20 as given by the coding disk, the sensor 62, and the counter 65 of the control assembly shown in FIG. 6, and more precisely immediately before and immediately after signal H8, respectively.

In FIG. 7, and also with reference to FIG. 6, it can be seen that the wheel 56 arrives at the end of its stroke against the portion 105 of the cam 55 for opening the body of the envelope. The lever 9 then holds the opening fingers 7 in a retracted position in front of the body of the envelope. A fan which is shown at 115 in FIG. 7 but which is omitted from the other figures in order to avoid overcrowding, is mounted in the top portion 3A of the insertion device 3 and is oriented to blow across the body of the envelope where it joins the flap 110, thereby contributing to the subsequent opening of the envelope.

In FIG. 8, the fingers 7 can be seen to be inserted into the body of the envelope, thereby opening it. With reference to FIG. 6, it can be deduced that after the signal H8, the wheel 56 is against the portion 106 of the cam 55 for opening the envelope body. The lever 9 has therefore pivoted relative to its preceding position, thereby pushing the opening fingers into the body of the envelope which they now hold open. The body of the envelope is held open so long as the wheel 56 remains on the portion 106 of the cam 55, i.e. up to clock signal H21, by which time the carriage 33 is already partially engaged in the envelope.

The main advantages of the sheet insertion device of the present invention include the following:

it is easily implemented with pusher fingers fixed on the carriage each having a sheet-grasping nib which is also fixed, and which is formed by shaping at the front of each of the pusher fingers and which projects only slightly above the fixed inlet tray; this makes it possible to return the pusher fingers to the rear of the fixed inlet tray without retracting them and without interferring too much with the sheet waiting for the next insertion operation, while nevertheless ensuring that each sheet to be inserted is reliably grasped by virtue of the holding-down fingers which are normally retracted and which are extended simultaneously with the sheet retaining fingers being retracted;

it is easy to adapt the fixed inlet tray and the retaining fingers, and also the carriage, to various different possible sheet formats;

the openable structure of the insertion device 3 provides easy access to the inside of the device in the event of an accidental paper jam;

the insertion device is reliably controlled in conjunction with the other devices of the machine regardless of whether they are controlled mechanically or electronically, and the various control cycles are accurately defined relative to one another causing specific commands to be triggered at successive angular positions of a common driving cam shaft, with said successive angular positions being detected during each complete rotation of the drive shaft relative to a reference angular position which is also detected on each complete rotation of the drive shaft, i.e. for each cycle; and the rate at which insertion cycles are performed can readily be adapted to the requirements of machine utilization merely by providing a corresponding change in the speed of rotation of said drive shaft.

The present invention has been described with reference to the particular embodiment shown in the accompanying drawings. Naturally, detailed modifications could be made thereto and/or various means could be replaced by other, equivalent means without thereby going beyond the scope of the invention.

I claim:

1. A sheet insertion device for inserting sheets into envelopes, the device comprising:

a fixed insertion station per se, fed with empty envelopes which are separate from one another;

a fixed sheet inlet station including a fixed inlet tray, said station being at a distance from the insertion station and being fed with sheets which are separate from one another;

a sheet transfer and insertion tray referred to as a "carriage" which is driven in translation along a "go" stroke from a first position in which it is retracted beneath the fixed inlet tray to a second position in which it is at least partially engaged in the envelope present in the insertion station, and also along an opposite "return" stroke, said carriage being fixed with pusher fingers having forwardlydirected sheet grasping means for grasping the sheet present in the inlet station, said fingers projecting above the level of the inlet station in order to retain the sheet by their grasping means and to push it during said go stroke, wherein said pusher fingers and said forwardly-directed sheet grasping means are fixed relative to each other and are fixed relative to the carriage, with said forwardly-directed grasping means projecting just above the level of the inlet station in order to leave them free to pass beneath a sheet waiting in the inlet station during the return stroke of the carriage, and wherein the sheet insertion device further includes holding-down fingers mounted above the inlet station and controlled to take up a holding-down position against the inlet station at least during the beginning of said carriage go stroke in order to force the sheet beneath said grasping means, thereby ensuring that the sheet is taken by said grasping means of each pulser finger, and also having a retracted position above the inlet station during the remainder of the go stroke and during the return stroke of the carriage in order to leave the inlet station free to be fed with a new sheet.

2. A sheet insertion device according to claim 1, further including retaining fingers for retaining the sheet present in the inlet station, said fingers being put into an obstacle position at the front of the inlet station in order to retain a sheet and also in a retracted position in order to allow a sheet to be transferred, said device being wherein said retaining fingers and said holding-down fingers are coupled to each other by a set of levers for controlling them simultaneously so that the retaining fingers are retracted when the holding-down fingers are extended, and vice versa.

3. A sheet insertion device according to claim 2, further including sheet anti-return lugs mounted above said insertion station and put either into a low position against an envelope which is present substantially level with the junction zone between the envelope body and its flap, at least during the beginning of the carriage return stroke, in order to retain the sheet engaged with the carriage in the envelope, or else into a raised position, at least during the engagement of the carriage with the sheet into the envelope.

4. A sheet insertion device according to claim 2, wherein said retaining fingers are mounted on a common shaft carried by a support which is adjustable relative to the front of said inlet station by means of a manual control connected to the support.

5. A sheet insertion device according to claim 2, wherein said inlet station comprises a fixed central tray and two side plates which are constituted by angle section bars and which are mounted to be simultaneously adjustable towards and away from each other relative to said central tray by means of a manual control which is linked to said plate.

6. A sheet insertion device according to claim 3, further including a control assembly mounted on a common drive shaft with respect to which the control sequences of said device within an insertion cycle are defined relative to each other for each complete rotation of said drive shaft.

7. A sheet insertion device according to claim 6, wherein said control assembly includes firstly a flywheel-forming crank fixed on said drive shaft, and a link actuated by the crank and coupled to said carriage in order to drive it, and secondly a coding disk for encoding successive angular positions of the drive shaft which positions are detected by an associated sensor.

8. A sheet insertion device according to claim 7, wherein said control assembly further includes a first cam having at least two distinct peripheral portions which are associated with controlling a link for actuating said sheet anti-return lugs to which it is coupled in order to move them between a high position and a low position.

9. A sheet insertion device according to claim 8, and further including means for opening the body of the envelope present in the insertion station, wherein said opening means comprise opening fingers which are retractively mounted in front of the body of the envelope present in said insertion station, and in that said control assembly further includes a second cam mounted on said drive shaft and having two peripheral portions for controlling a lever for actuating said opening fingers respectively between a retracted position and a non-retracted position in which they are engaged in said envelope.

10. A sheet insertion device according to claim 9, wherein said control assembly further includes an auxiliary cam carried by said drive shaft and analogous to said second cam, and which is angularly offset relative thereto by a small advance, and which is mounted to be selectively coupled or not coupled to said opening fingers to put into their non-retracted position under the control of said auxiliary cam while the return of said opening fingers to their retracted position remains controlled by said second cam, in the event that said auxiliary cam is coupled to said lever for actuation the opening fingers.

11. A sheet insertion device according to claim 9, wherein said opening means include a fan mounted at the front of and above the body of the envelope present in the insertion station, and blowing across the body of the envelope in its junction zone with the flap of the envelope.

12. A sheet insertion device according to claim 7, wherein the coding disk has a non-looped series of first openings distributed at a regular pitch substantially around its periphery and defining a gap from which few of said first openings are missing.

13. A sheet insertion device according to claim 12, wherein said coding disk also has a second opening which is radially offset relative to said series of first openings and which is at least partially level with said gap from which said first openings are missing, and said sensor is a pair of sensors with one of the sensors of the pair being for detecting the passage of said first openings and with the other sensor of the pair being for detecting the passage of the second opening.

14. A sheet insertion device according to claim 13, wherein said pair of sensors is connected to a counter and in that said first detected openings are used for delivering a sequence of clock signals and said second openings is used for delivering a reference signal for resetting said sequence of clock signals to zero.

15. A sheet insertion device according to claim 14, wherein the individual sensors of the pair of sensors include optical fibers respectively coupled to two emitting cells in order to detect said openings from a distance.

16. A sheet insertion device according to claim 15, wherein said second opening is at least twice as long as said first openings and extends at least partially level with said terminal first opening giving rise to the last signal of the sequence, and said individual sensors are angularly offset from each other in order to detect said first and second openings.

17. A sheet insertion device according to claim 2, comprising two portions, a bottom portion mounted directly on a chassis to which said carriage belongs, with said fixed inlet tray and a feed path for feeding the fixed inlet tray with separate sheets, and the other portion being referred to as a top portion carried by cheek pieces mounted firstly to pivot at one of their ends about a shaft in said chassis, and secondly locked by an unlockable manual control substantially at their opposite end to said chassis, and which include the means for guiding said sheets along said feed path, said retaining fingers, said holding-down fingers, and said set of levers coupling said retaining fingers and said holding-down fingers.

* * * * *